United States Patent [19]

Skovgaard

[11] Patent Number: 4,528,694

[45] Date of Patent: Jul. 9, 1985

[54] CARRY-BAG

[75] Inventor: Leif O. Skovgaard, Oksbol, Denmark

[73] Assignee: Gople-Pack and Industrial Marketing ApS, Oksbøl, Denmark

[21] Appl. No.: 600,199

[22] PCT Filed: May 22, 1981

[86] PCT No.: PCT/DK81/00055

§ 371 Date: Jan. 15, 1982

§ 102(e) Date: Jan. 15, 1982

[87] PCT Pub. No.: WO81/03317

PCT Pub. Date: Nov. 26, 1981

Related U.S. Application Data

[63] Continuation of Ser. No. 341,993, Jan. 15, 1982, abandoned.

[30] Foreign Application Priority Data

May 22, 1980 [DK] Denmark ..... 2247/80

[51] Int. Cl.[3] ..... A45C 3/04; B65D 30/08; B65D 33/06

[52] U.S. Cl. ..... 383/10; 383/17; 383/27; 383/87; 383/110

[58] Field of Search ..... 383/9, 10, 27, 86, 87, 383/17, 86.1, 86.2, 110, 78, 79, 6

[56] References Cited

U.S. PATENT DOCUMENTS

| | | | |
|---|---|---|---|
| 1,291,024 | 1/1919 | Kleebauer | 229/62 X |
| 1,661,143 | 2/1928 | Littman | 229/62 |
| 2,172,555 | 9/1939 | Wolf | 229/62 X |
| 2,319,127 | 5/1943 | Guenther et al. | 383/10 |
| 2,667,198 | 1/1954 | Klein | 150/12 X |
| 3,383,017 | 5/1968 | Krings | 150/12 X |
| 3,429,497 | 2/1969 | Dorfman | 150/12 X |
| 3,606,137 | 9/1971 | Kugler | 383/10 X |
| 3,836,068 | 9/1974 | Schwarzkopf | 150/12 X |
| 4,211,267 | 7/1980 | Skovgaard | 383/87 X |

FOREIGN PATENT DOCUMENTS

| | | | |
|---|---|---|---|
| 641615 | 4/1964 | Belgium | 229/54 R |
| 398561 | 8/1941 | Canada . | |
| 695390 | 10/1964 | Canada . | |
| 1932047 | 1/1971 | Fed. Rep. of Germany . | |
| 2031494 | 12/1971 | Fed. Rep. of Germany | 383/10 |
| 2048758 | 4/1972 | Fed. Rep. of Germany | 383/10 |
| 2215612 | 10/1973 | Fed. Rep. of Germany . | |
| 2173117 | 2/1976 | France . | |
| 364920 | 12/1970 | Sweden . | |
| 1364688 | 8/1974 | United Kingdom | 229/54 R |
| 1363911 | 8/1974 | United Kingdom . | |
| 1396290 | 6/1975 | United Kingdom . | |
| 1407563 | 9/1975 | United Kingdom . | |
| 1414984 | 11/1975 | United Kingdom . | |

*Primary Examiner*—William Price
*Assistant Examiner*—Sue A. Weaver
*Attorney, Agent, or Firm*—Fleit, Jacobson, Cohn & Price

[57] ABSTRACT

A carry-bag includes two wall sheets (34,36) joined or coherent to define a bag portion, and the respective top portions of the wall sheets are provided with gripping and carrying openings. In order to provide a strong, easy to use, and relatively tight closing to the interior of the bag portion, the top portion of a first wall sheet (34) has been folded inwardly and attached to define an insertion pocket (24), and a gripping opening is provided in the pocket. A top portion of the other wall sheet (36) is shaped as an insertion tongue (32) which is also provided with a gripping opening (6) and is adapted to be received in the interior of the pocket (24) so that the two gripping openings are at least partially coextensive. In particular, if a carrying stick has been inserted in a passage (8) along the top edge of the insertion tongue, there is provided a strong carrying means which also closes effectively to the interior of the bag portion, since the top edge of the tongue will be drawn against the bottom in the pocket, when carrying the bag.

8 Claims, 5 Drawing Figures

CARRY-BAG

Figure 1:
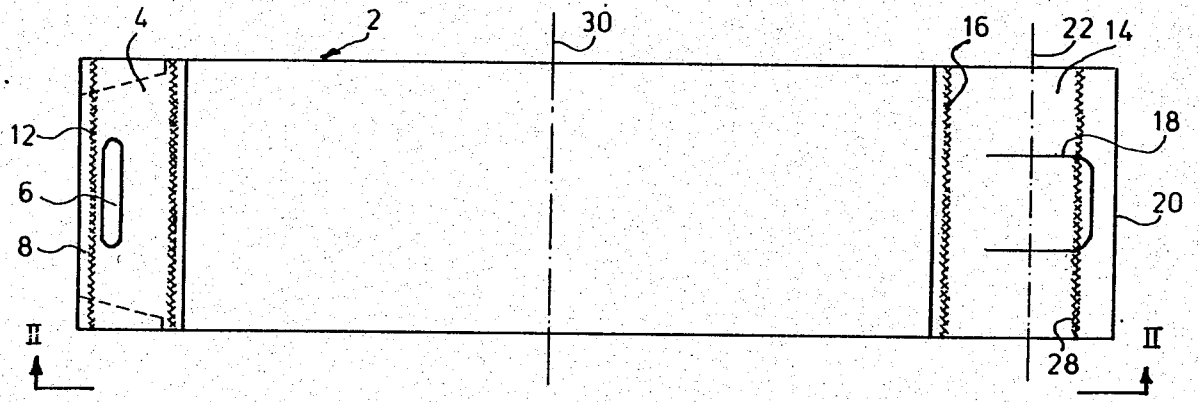

This application is a continuation of application Ser. No. 341,993, filed Jan. 15, 1982, abandoned.

The present invention relates to a carry-bag comprising two wall sheets which are joined together and/or are coherent along two opposed side edges and along a bottom edge so as to define a bag portion, the top portions of said wall sheets being provided with respective gripping and carrying openings.

Carry-bags of this type including hand grip apertures in the top portion thereof are known in several designs. There is, however, a need for a carry-bag having a simple closing arrangement, whereby the top of the bag can be closed so that goods in the interior of the bag can be effectively and relatively tightly confined therein. This need is particularly outstanding in connection with so-called thermo carry-bags e.g. for storing and transporting frozen products.

It is an object of the invention to satisfy this need by providing a carry-bag of the actual type having a carrying and closing arrangement which is sturdy, simple to use and to manufacture and whereby the access to the interior of the carry-bag can be effectively and relatively tightly closed.

This is achieved by the carry-bag of the invention which is characterized in that the top portion of one of the wall sheets is folded inwardly and backwardly and is attached so as to define an insertion pocket, the entry of said pocket being at the inner side of said wall sheet, when the carry-bag is in its open condition, a first gripping opening being defined in the insertion pocket thus provided, and in that the top portion of the other wall sheet is shaped as an insertion flap provided with a second gripping opening and adapted for introduction into the interior of said insertion pocket so that said first and second gripping openings are at least partially coextensive with said insertion flap received in said pocket.

When grasping and lifting the carry-bag in its closed condition, i.e. with the insertion flap introduced into the corresponding insertion pocket, by putting the fingers of a hand through the respective gripping openings, the leading or top edge of the insertion flap will be pulled into or up into the insertion pocket, thereby tightening against the bottom of the pocket. In a preferred embodiment, this tightening effect is further improved by providing the top edge of the insertion flap with a passage or channel which includes or is adapted to receive a transverse carrying stick in the area along the top edge of the flap. Such a carrying stick also renders the bag sturdier and more comfortable to carry in the hand.

The gripping openings in the insertion flap and in the insertion pocket, respectively, may be designed as usual hand gripping apertures which are at least partially coextensive in the closed condition of the carry-bag. In a particularly preferred embodiment, the gripping opening in the insertion pocket is, however, defined by a U-shaped cut provided in the wall sheet before the formation of the pocket by folding the wall-sheet, and wherein the bottom of the U-shaped cut extends along and spaced from the top edge of the unfolded wall sheet. A subsequent formation of the insertion pocket by folding across the two legs of the U-cut will thereby provide a closing flap having a free edge which can be adapted to be threaded through the gripping opening in the insertion flap in the closed condition of the carry-bag, whereafter the closing flap can be detachably connected with the outer surface of the carry-bag, e.g. by means of a snap fastener. Thus, in this embodiment, the gripping opening in the insertion pocket defines a notch in the bottom of the completed pocket, whereby the gripping opening of the insertion flap will be exposed completely or partially in the closed condition of the carry-bag. The tightness in the closing of the bag is, however, further improved due to the fact that the closing flap tends to prevent the insertion pocket from opening and also due to the fact that the closing flap forms a flap-over closure.

Preferably, the top portions of the two walls sheets have been doubled by foldings before providing the insertion flap and insertion pockets, respectively, whereby the insertion pocket in particular, which shall be able to carry a substantial part of the bag load, becomes very sturdy.

According to the invention the side edge seals of the wall sheets are preferably continued through the entire length of the carry-bag in order to close the sides of the insertion pocket, whereas the corresponding side edges of the insertion flap are retracted and kept free of the respective side edge seals. Thereby is achieved a structure which is strong and simple to produce.

Figure 2:
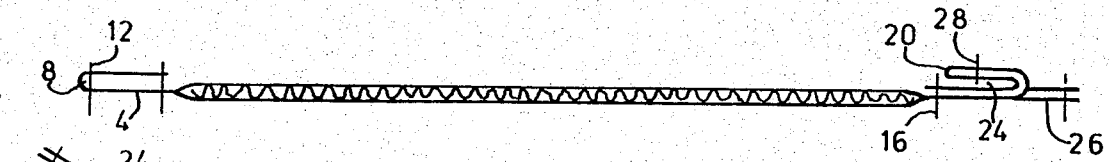
Figure 3:
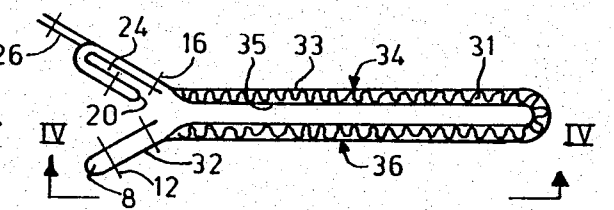
Figure 4:
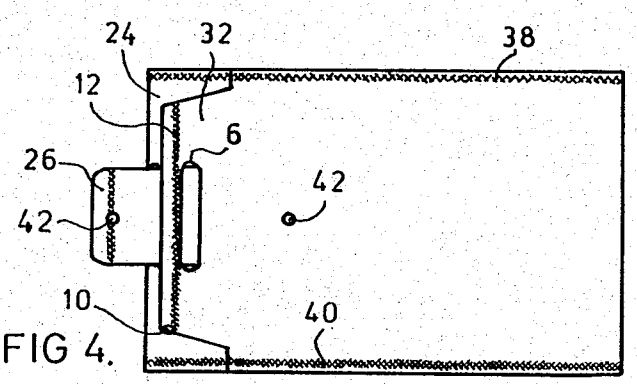
Figure 5:
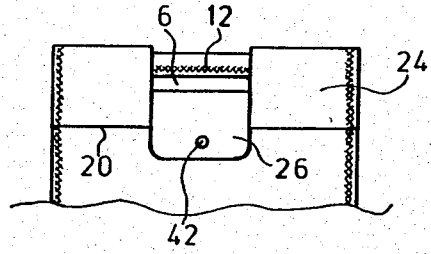

In the following, the invention will be further described with reference to the drawings, wherein FIG. 1 is plan view showing a carry-bag according to the invention during an initial step of manufacture, FIG. 2 is a schematic side view showing the bag blank of FIG. 1 (11—11) during a subsequent step of manufacture, FIG. 3 is a schematic side view similar to FIG. 2, but showing the bag blank folded to its final bag shape, FIG. 4 is a plan view showing the bag blank of FIG. 3 (IV—IV) in its completed form with side edge seals, and FIG. 5 is a partial plan view showing the top portion of the carry-bag of FIG. 4 in its closed condition.

A bag blank 2 shown in FIG. 1 is for further processing into a carry bag according to the invention. The blank may be prepared from a single-layer web, e.g. of polyethylene, but as indicated in FIGS. 2 and 3, the blank may also be prepared from two outer layers, e.g. of polyethylene and an intermediate heat insulating layer, e.g. of polyester wadding.

The bag blank 2 in FIG. 1 has been doubled at the two end areas thereof which subsequently are to define the top portions of the carry-bag. One of the end portions 4 is provided with a gripping opening 6, and the end portion 4 is, moreover, designed as an insertion flap or tongue by means of appropriately disposed transverse weldings. In this connection, the end portion 4 is preferably slightly tapered by trimming the side edges of the end portion as indicated by broken lines in FIG. 1. The leading edge of the end portion 4 is also provided with a channel or passage 8 which is adapted for inserting a carry-stick therein preferably a round stick 10 (FIG. 4) extending along the top edge of the insertion tongue in the completed carry-bag. In the embodiment shown, the passage 8 has been provided in connection with the folding of the end portion 4 and by means of a transverse welding 12 and, preferably, the carrying stick has a length which essentially corresponds to the length of the top edge of the insertion tongue.

The other end portion 14 of the bag blank 2 in FIG. 1 has also been doubled by reverse folding and is attached by means of a transverse welding 16. Such a doubling is not necessary in all cases, but is preferable, in particular when the completed carry-bag shall be able to carry and withstand heavy goods. In the end portion 14 there is, moreover, provided a U-shaped cut 18 having a bottom or central portion which extends along, but spaced from the leading edge 20, and two legs directed away from the leading edge 20 of the end portion 14.

In a subsequent step, which is illustrated schematically in FIG. 2, the end portion 14 is folded about a line 22 to define an insertion pocket 24 having an entry defined by the edge 20 which is the leading edge of the bag blank in FIG. 1. As indicated at the right hand end of FIG. 2, the portion which has been cut free by the U-cut 18, defines a closing flap 26, the width and location thereof being so adapted that the closing flap can be inserted through the gripping opening 6 in the completed carry-bag as will be further described. When the closing flap 26 includes several layers of material, such as is the case in the example shown, it is appropriate that the flap is sealed by means of a transverse welding as indicated at 28 in FIG. 1.

The area which is surrounded by the U-cut 18 in FIG. 1, also defines a gripping opening in the shape of a notch in the bottom of the insertion pocket 24.

The bag blank in FIG. 2 is then folded about a transverse line 30 which is at the middle of the blank 2 in FIG. 1, resulting in a shape as that shown schematically in FIG. 3, wherein the insertion tongue 32 and the insertion pocket 24 are shown slightly separated for the sake of clarity and in order to show the access to the interior of the real bag portion now defined by two wall sheets 34, 36. It is to be noted that the folded material portions are shown excessively separated in FIGS. 2 and 3 for the sake of clarification, and the weldings are, moreover, only indicated schematically by short cross lines.

Thereafter the carry-bag is completed by preparing side edge sealings 38, 40 as shown in FIG. 4, and these edge sealings are extended or continued to the top edge of the carry-bag, thereby closing the sides of the insertion pocket 24, whereas the corresponding side edges of the insertion tongue 32 are still free to move. The carry-bag in FIG. 4 is shown in its open condition, i.e. with the insertion tongue 32 lying on the exterior of the insertion pocket 24. The carry-stick 10 can then be inserted in the channel 8 along the top edge of the insertion tongue and this may take place either at once or at a later time, possibly when taking the carry-bag into use.

FIG. 5 shows the closed condition of the carry-bag. Compared to the open condition shown in FIGS. 3 and 4, the insertion tongue 32 has been introduced into the interior of the pocket 24, and, thereafter, the closing flap 26 has been inserted through the gripping opening 6 in the tongue 32. Then the closing flap 26 is pulled downwardly in FIG. 5, wherein the flap has been attached by means of a snap fastener 42, provided exteriorly on the wall sheet 36, which includes the insertion tongue 32. As will appear from FIG. 5, there has hereby been provided a gripping opening being a notch in the bottom of the insertion pocket 24, i.e. in the top edge of the wall sheet 34 which includes or defines the insertion pocket. Through this notch there is relatively free access to the gripping opening 6 in the insertion tongue which is disposed in the interior of the pocket.

When carrying the closed carry-bag in a hand, the top edge of the insertion tongue will be drawn against the bottom of the pocket, whereby a tightening or sealing effect is created, in particular when a carrying stick 10 is used. Moreover, the closing flap, which is attached as shown in FIG. 5, will retain the access edge 20 of the pocket so that the pocket will not open to a substantial extent due to vertical tensions which arise when carrying the closed bag. In addition, the flap 26 itself defines a tightening flap-over closure. Thereby an effective, sturdy and relatively tight closure to the interior of the bag has been provided.

Due to this closure, and also due to the design of the carry-bag, the carry-bag according to the invention is particularly useful as a re-usable thermo carry-bag. However, as indicated above, the carry-bag according to the invention is not restricted to this particular use, since the carry-bag may also be produced from a singlelayer stock material which may be plastic material or paper of an appropriate quality, and since the weldings may be replaced by corresponding gluings.

Embodiments as that schematically shown in FIG. 3 having a flexible and compressible padding 31 between flexible cover sheets or foils 33, 35 are, however, particularly useful as thermo-insulating bags. In one embodiment, the outer cover sheet 33 is a smooth sheet prepared from a basic material, preferably granulated polyethylene, while admixing e.g. 1–3% aluminium powder or another material having corresponding properties. However, the outer cover layer 33 may also consist of other sheets, including sheet laminates, such as a foamed polyethylene sheet.

The heat insulating padding 31 may be of a material such as polyester wadding, which has the property that the material approximately reassumes its initial thickness which may be of the order of 2 cm, when releaving the material after a compression.

The inner cover sheet 35 may be a polyethylene sheet or a sheet laminate possibly including an intermediate aluminium layer.

As mentioned above, embodiments as that of FIG. 3 are particularly useful as thermo-insulating bags not only due to the heat insulating effect of the pading 31, but also due to the bulk and compressibility of the bag walls. Thus, assuming that an object such as a deep-frozen item, has been deposited in the interior of the bag in FIG. 3, then the walls of the bag will adapt to the shape of the object when carrying the bag since the bag walls are able to yield and enclose the object which is thereby confined in the bag wall material. This is due to the fact that the bag walls yield and fit around the object because of inwardly directed components of the tension forces which are present in the bag walls when the bag is carried in the usual manner.

An object may thereby be kept cold (or hot) in the carrying-bag during an extended period of time, since the object will be confined in a space or volume which is not substantially greater than the volume of the object.

The above effect may also be obtained to some extent with other closing and carrying means for the carry-bag, and an aluminium-containing outer cover sheet or foil is not strictly necessary, either. However, the object-confining effect will be obtained to a particularly great extent in connection with a closing and carrying arrangement as that of the bag of the invention, since the tension forces in the bag walls will be evenly distributed over the width of the bag.

The bag portion of the carry-bag of the invention may also appropriately be provided with suitably located vent openings so that air may escape from the interior of the bag walls, e.g. when stacking and storing bags in flat condition.

In summary, it is an essential feature of the carry-bag of the invention that a closing flap corresponding to flap 26 is adapted to extend from one of the bag wall sheets, through the gripping openings, and then to the other bag wall sheet. One end of the closing flap is joined to or integral with the first bag wall, while the other end is free, but is adapted to be releasably attached to the other bag wall such as shown in FIG. 5. The closing flap can thereby prevent the insertion pocket 24 from being opened and the flap will also cover the access to the interior of the bag which would otherwise exist at the gripping openings, if the flap was not present. Preferably, the closing flap has a width which substantially corresponds to the width or transverse dimension of the gripping opening 6 in the insertion flap or tongue 32.

In embodiments which include a padding corresponding to padding 31, it should be noted that the padding only extends through the bag portion, whereas at least one of the cover layers corresponding to sheets 33 and 35 (FIG. 3), continues through the respective end portions corresponding to end portions 4 and 14 (FIG. 1).

Finally, it will be understood that details of the specific embodiment illustrated in the drawing and described above, may be varied or modified without departing from the scope of the invention.

I claim:

1. A carrier bag comprising:

a first wall sheet;

a second wall sheet joining said first wall sheet along two opposed side edges and along a bottom edge so as to define a bag portion;

a top portion of said first wall sheet being folded upon itself to define an insertion pocket having an entry edge located at an inner side of said first wall sheet, when said bag is in an open condition and said top portion of said first wall sheet includes a cut defining a first gripping opening and a closing flap;

a top portion of said second wall sheet defining an insertion flap adapted for introduction into the interior of said insertion pocket;

a second gripping opening defined by said insertion flap adapted for introduction into the interior of said insertion pocket so that said first gripping opening and said second gripping opening are at least partially coextensive when said insertion flap is received in said insertion pocket;

said closing flap having a free front edge, the size and location of said closing flap being so adapted that said closing flap extends through said first gripping opening and said second gripping opening when said insertion flap is received in said insertion pocket to close access to the interior of said bag portion at said first gripping opening and said second gripping opening; and means for removably attaching said free front edge of said closing flap to the outer side of said second wall sheet when said insertion flap is received in said insertion pocket.

2. A carrier bag of claim 1, wherein said cut in said insertion pocket is a U-shaped cut provided in said first wall sheet before the formation of said insertion pocket by folding, a portion of said U-shaped cut extending along, but spaced from, a top edge of said unfolded first wall sheet, and wherein a portion of said first wall sheet cut free by said U-shaped cut forms said closing flap.

3. The carrier bag of claim 1, wherein a top edge of said insertion flap is provided with a passage adapted to receive a transverse carrying stick extending along said top edge.

4. The carrier bag of claim 1, wherein said top portions of said first and said second wall sheets have been doubled by folding before forming said insertion flap and said insertion pocket respectively.

5. The carrier bag of claim 1, wherein side edge seals of said first and said second sheets are extended to a top edge of said bag, thereby sealing opposite sides of said insertion pocket, whereas the corresponding side edges of said insertion flap are cut away and kept free of the respective side edge seals.

6. The carrier bag of claim 1, wherein said first wall sheet and said second wall sheet each includes at least one flexible cover layer and a compressible layer.

7. The carrier bag of claim 6, wherein said compressible layer is formed of a material capable of substantially recovering its initial thickness, when the material is relieved after compression.

8. The carrier bag of claim 7, wherein said material is a heat insulating material enclosed between two flexible cover layers.

* * * * *